US010240884B1

(12) United States Patent
De Leon et al.

(10) Patent No.: US 10,240,884 B1
(45) Date of Patent: Mar. 26, 2019

(54) MOUNTABLE FIXTURE FOR ABSORBING RECOIL

(71) Applicants: Jorge David De Leon, Ben Alton, MD (US); James F. Cahill, Fredericksburg, VA (US); Ishankumar Patel, Glen Allen, VA (US); Reginald Heggie, Fredericksburg, VA (US); Gregorio Morales-Caez, Fredericksburg, VA (US); Nelson C. Hall, Fredericksburg, VA (US); Arnold R. Hamlet, III, Montross, VA (US)

(72) Inventors: Jorge David De Leon, Ben Alton, MD (US); James F. Cahill, Fredericksburg, VA (US); Ishankumar Patel, Glen Allen, VA (US); Reginald Heggie, Fredericksburg, VA (US); Gregorio Morales-Caez, Fredericksburg, VA (US); Nelson C. Hall, Fredericksburg, VA (US); Arnold R. Hamlet, III, Montross, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/884,875

(22) Filed: Jan. 31, 2018

Related U.S. Application Data

(63) Continuation-in-part of application No. 13/802,880, filed on Mar. 14, 2013, now abandoned.

(51) Int. Cl.
*F41A 23/00* (2006.01)
*F41A 23/34* (2006.01)
(Continued)

(52) U.S. Cl.
CPC ..... *F41A 23/34* (2013.01); *F41A 23/26* (2013.01); *F41A 23/52* (2013.01); *F41A 23/56* (2013.01); *F41A 25/12* (2013.01)

(58) Field of Classification Search
CPC ..... F41A 23/56; F41A 23/00; F41A 23/34; F41A 23/36; F41A 23/38; F41A 23/40;
(Continued)

(56) References Cited

U.S. PATENT DOCUMENTS 2,425,563 A 8/1947 Marcel ..... 89/40.01
2,459,753 A 1/1949 Brown ..... 280/103
(Continued)

*Primary Examiner* — Daniel P Cahn
(74) *Attorney, Agent, or Firm* — Gerhard W. Thielman, Esq.

(57) ABSTRACT

A fixture is provided for supporting load from weapons recoil, being mountable on a flat bed of a road vehicle disposed on ground. The flat bed can receive a weapons mount. The vehicle has longitudinal, lateral and vertical orientation directions. The fixture includes a horizontal deck, a slide assembly, a dampener housing, port and starboard lateral beams, together with first, second and third posts. The horizontal deck receives the weapons mount. The slide assembly supports the deck. The dampener housing receives the slide assembly. The port and starboard lateral beams extend laterally from the dampener housing. The first and second posts extend vertically downward from their corresponding beams to engage the ground. The third post extends vertically downward from the housing to engage the ground. Brackets on the slide assembly extend longitudinally from the platform for enabling the vehicle to drive away from the fixture. The posts are retractable for stowage and extendible for raising the flat bed above the ground.

13 Claims, 19 Drawing Sheets

(51) Int. Cl.
*F41A 23/52* (2006.01)
*F41A 23/26* (2006.01)
*F41A 25/12* (2006.01)
*F41A 23/56* (2006.01)

(58) Field of Classification Search
CPC ..... F41A 23/42; F41A 27/00; F41A 27/04; F41A 27/30; F41A 27/06; F41A 23/24; F41A 25/00; F41A 25/26; F41A 27/18; F41A 27/20
USPC ..... 89/40.08, 40.11, 40.12, 40.13, 40.14, 89/40.02, 40.15; 296/26.08, 26.09; 280/763.1, 766.1; 42/94; 182/127, 69.6
See application file for complete search history.

(56) References Cited

U.S. PATENT DOCUMENTS

| | | | | |
|---|---|---|---|---|
| 3,112,836 | A | 12/1963 | Back | 414/498 |
| 3,529,694 | A | 9/1970 | Atchey | 182/2.7 |
| 4,000,924 | A | 1/1977 | Blasingame | 296/35.3 |
| 4,142,710 | A | 3/1979 | Okuda | 254/423 |
| 4,273,244 | A | 6/1981 | Jansen et al. | 212/181 |
| 4,384,215 | A | 5/1983 | Hirano et al. | 182/66.2 |
| 5,192,102 | A | 3/1993 | Mertins et al. | 280/766.1 |
| 5,417,540 | A | 5/1995 | Cox | 414/495 |
| 5,461,961 | A | 10/1995 | Baus et al. | 89/1.815 |
| 5,868,218 | A | 2/1999 | Lawson | 182/69.6 |
| 6,227,517 | B1 | 5/2001 | Wohl | 248/694 |
| 6,533,045 | B1 | 3/2003 | Cooper | 173/28 |
| 6,672,196 | B1 * | 1/2004 | Ang | F41A 23/46 89/42.02 |
| 7,418,897 | B2 | 9/2008 | Balbo | 89/40.02 |
| 7,677,625 | B2 | 3/2010 | Gosselin et al. | 296/26.09 |
| 8,061,754 | B1 | 11/2011 | Webb | 296/61 |
| 8,292,032 | B2 | 10/2012 | Knaak | 182/141 |
| 8,305,287 | B2 | 11/2012 | Sabatino | 343/881 |
| 9,649,903 | B2 * | 5/2017 | Raczek | F41A 23/28 |
| 2002/0060269 | A1 * | 5/2002 | Robinson | B64C 39/001 244/62 |
| 2006/0043718 | A1 | 3/2006 | Mayer | 280/763.1 |
| 2006/0225567 | A1 * | 10/2006 | Balbo | F41A 23/56 89/42.02 |
| 2009/0261112 | A1 | 10/2009 | Kondo | 220/629 |
| 2011/0001309 | A1 | 1/2011 | Wang et al. | 280/766.1 |
| 2011/0168007 | A1 * | 7/2011 | Binek | F41A 23/32 89/43.01 |
| 2012/0036987 | A1 | 2/2012 | Guruprassad et al. | 89/1.806 |
| 2014/0059788 | A1 | 3/2014 | Edwards, III | 15/93.1 |
| 2014/0260941 | A1 | 9/2014 | De Leon et al. | 89/37.3 |

* cited by examiner

MOUNTABLE FIXTURE FOR ABSORBING RECOIL

CROSS REFERENCE TO RELATED APPLICATION

The invention is a Continuation-in-Part, claims priority to and incorporates by reference in its entirety U.S. patent application Ser. No. 13/802,880 filed Mar. 14, 2013, published as Application Publication 2014/0260941 and assigned Navy Case 101593.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to vehicular support for a weapons platform, or alternate structure that imposes transient loads. In particular, the invention relates to stands with retractable legs for shock absorption while firing.

Weapon systems, such as the M252 81 mm or RMS 6-L 120 mm mortar systems or M114 155 mm Howitzer or jet assisted take-off (JATO) drones, are brought to a forward operating base (FOB) by and operated on a conventional military vehicle, such as a flat-bed truck. (Note that the length unit "mm" denotes millimeters.) Similarly, a mortar carrier vehicle, such as the M1129A1 Stryker can incorporate the RMS 6-L for transport and operation. Such a conventional structural arrangement lacks independent operation of the weapon system and its transport.

SUMMARY

Conventional vehicle supports for weapon systems yield disadvantages addressed by various exemplary embodiments of the present invention, In particular, various exemplary embodiments provide a fixture for supporting load from weapons recoil, being mountable on a flat bed of a road vehicle disposed on ground. The flat bed can receive a weapons mount. The vehicle has longitudinal, lateral and vertical orientations.

In exemplary embodiments, the fixture includes a fixture is provided for supporting load from weapons recoil, being mountable on a flat bed of a road vehicle disposed on ground. The flat bed can receive a weapons mount. The vehicle has longitudinal, lateral and vertical orientations. The fixture includes a horizontal deck, a slide assembly, a dampener housing, port and starboard beams, together with first, second and third posts. The horizontal deck receives the weapons mount. The dampener housing receives the slide assembly that supports the deck. The beams extend laterally from the dampener housing.

In exemplary embodiments, the first and second (lateral) posts extend vertically downward from their corresponding beams to engage the ground. The third (center) post extends vertically downward from the housing to engage the ground. Brackets on the slide assembly extend longitudinally from the platform for enabling the vehicle to drive away from the fixture. The posts are retractable for stowage and extendible for raising the flat bed above the ground. Other various embodiments alternatively or additionally provide for stabilizing stiffeners mounted to the deck.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The Naval Surface Warfare Center Dahlgren Division (NSWCDD) has been tasked by the Office of the Secretary of Defense (OSD) to determine the feasibility of integrating an Enhanced Mortar Targeting System (EMTAS) onto a wheeled tactical platform or truck vehicle. The vehicle's suspension supports the recoil of the EMTAS with minor or no modification applied to the vehicle, which has the capability to store 120 mm rounds and extra charges. The vehicle has the means to lift the EMTAS off the vehicle's flat bed and setting the vehicle on the ground if needed for firing operation.

The Mobile Modular Weapon Platform Fixture System (MMWPFS) constitutes a system in which all these components together work in conjunction in unison to absorb extremely high recoil forces generated by the weapon system and transmit them to the ground surface without causing damage to the vehicle. Conventional platforms for a weapon system are available for a specific military vehicle but cannot be utilized outside the vehicle, leading to operational damage to vehicles and platform structure.

Figure 1A:
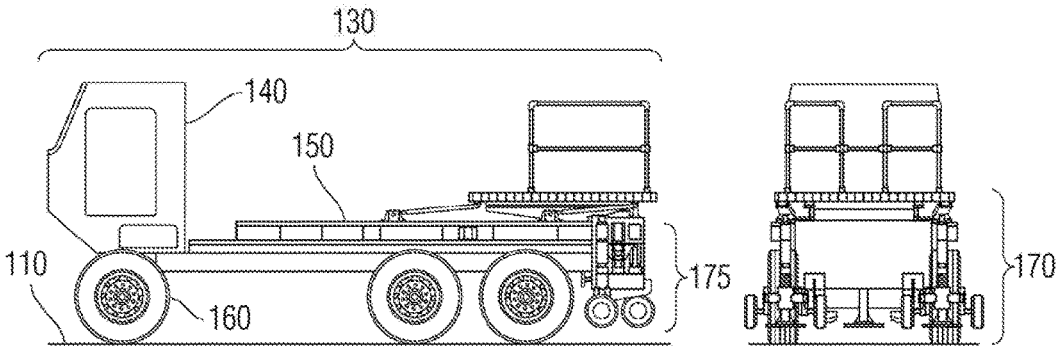
FIG. 1A is a set of elevation views of an exemplary platform-carrying truck.
Figure 1B:
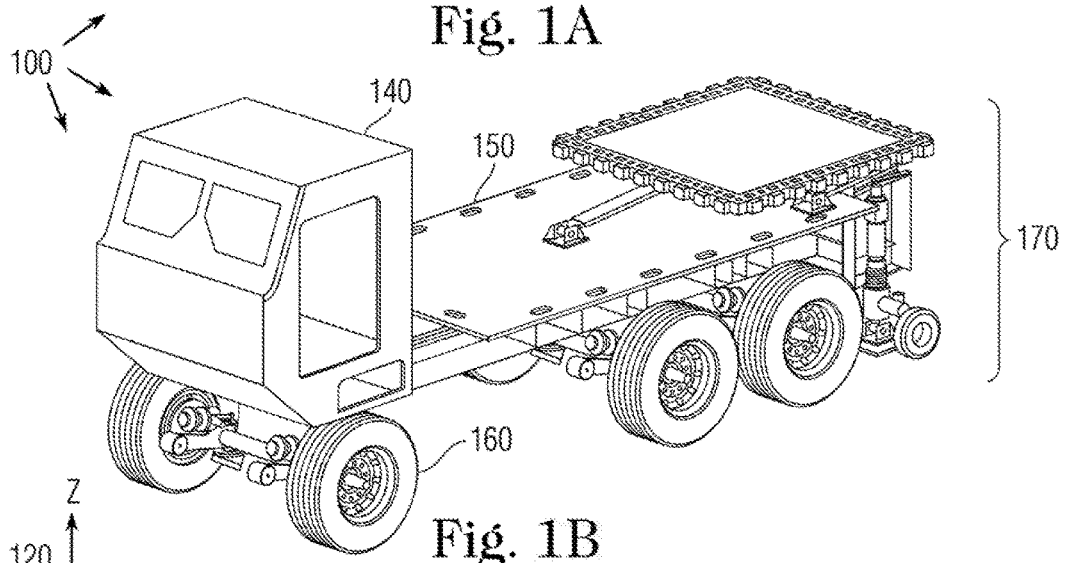
FIGS. 1B and 1C are perspective views of the truck.
Figure 1C:
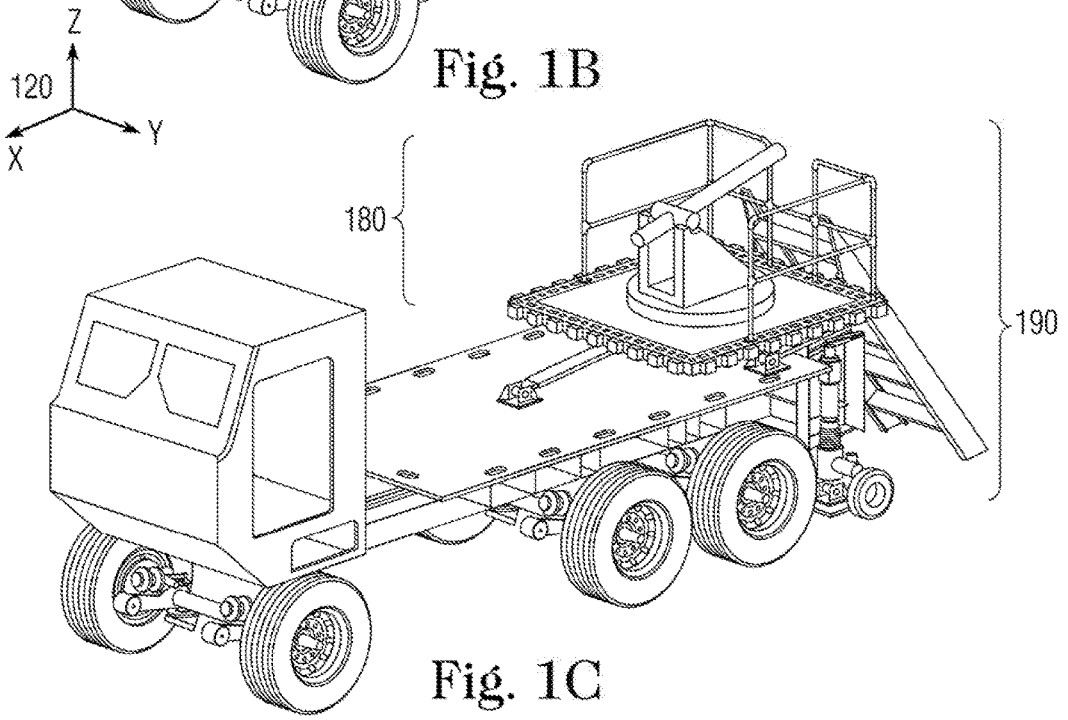
Figure 1D:
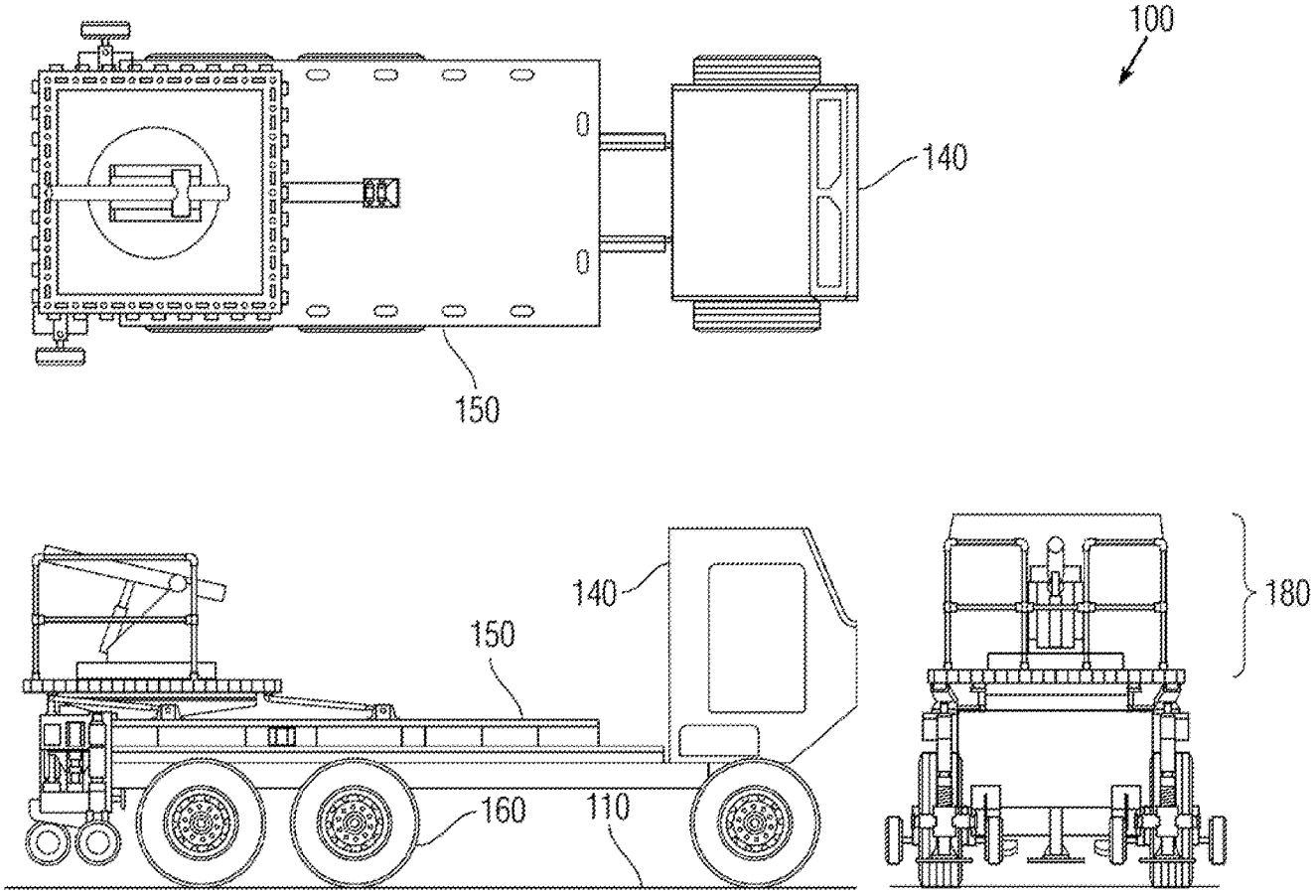
FIG. 1D is a set of plan and elevation views of the truck.

FIGS. 1A through 1D show sundry views 100 of an exemplary vehicle assembly disposed on the ground 110 with a compass rose 120 that indicates longitudinal (x), lateral (y) and vertical (z) directions. The longitudinal directional points forward; the lateral direction points port, and the vertical (or elevation) direction points upward. In particular, FIG. 1A illustrates an elevation view, FIGS. 1B and 1C provide isometric views, and FIG. 1D shows a set of plan and elevation views of the vehicle assembly with the weapons mount. The military vehicle 130 (e.g., truck) includes a cab 140 (for seating driver and/or passenger), a truck flat bed 150 and wheels 160. In the assembly, the flat bed 150 includes a support fixture 170, which includes a stowed support 175. A weapons superstructure 180 rests atop the fixture 170, which combined constitutes a stowed gun platform 190 as the Mobile. Modular Weapon Platform Fixture System (MMWPFS).

Figure 2B:
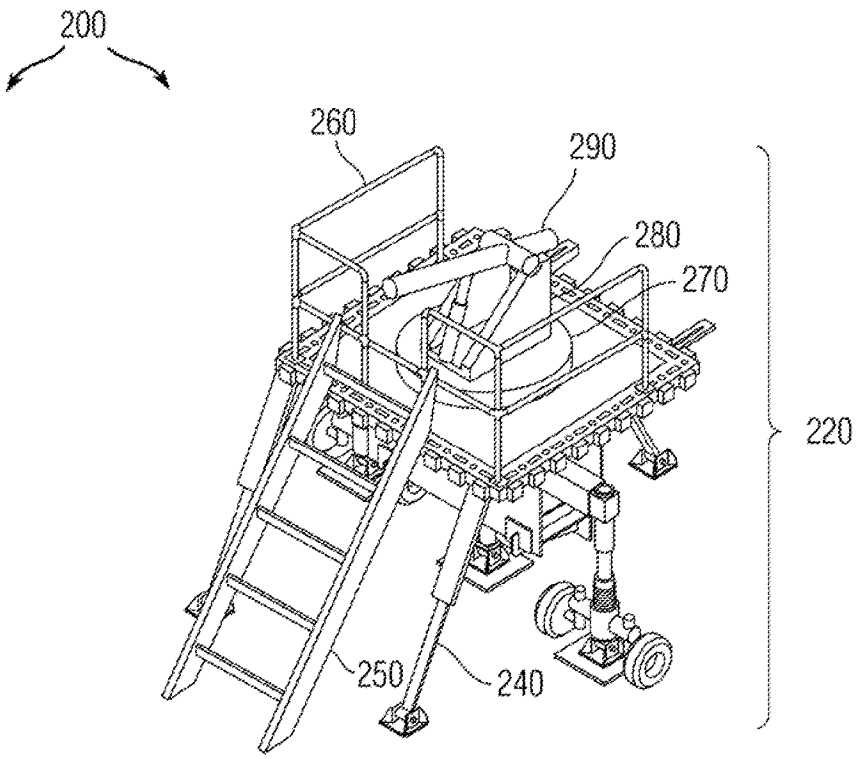
FIGS. 2A and 2B are perspective assembly views of a platform fixture, including a shock absorption stand with a mounting deck.
Figure 2A:
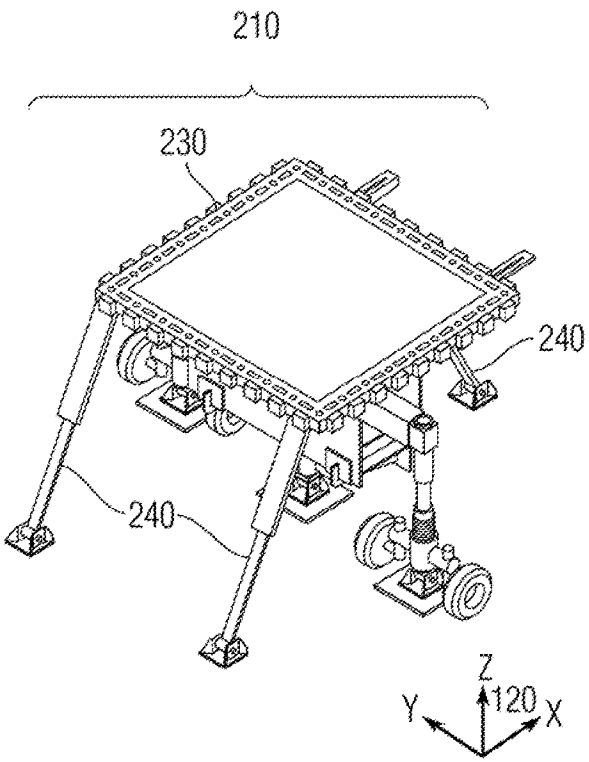
Figure 3:
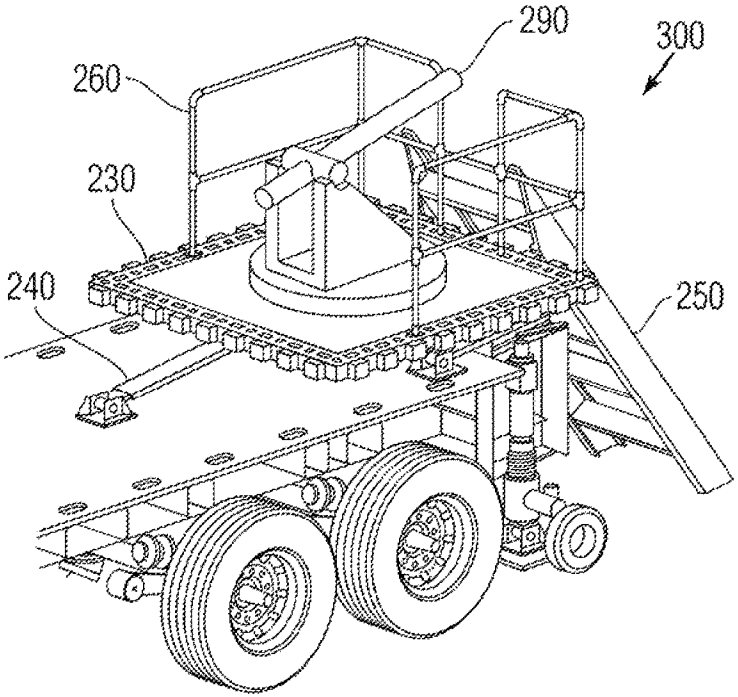
FIG. 3 is a perspective view of the platform fixture at the truck rear.

FIGS. 2A and 2B show perspective views 200 of a shock absorption stand 210 (as the fixture 170 deployed) on the ground 110, and assembly platform (or fixture) 220 (as the stowed platform 190 deployed) with the superstructure 180. The stand 210 includes a mounting deck 230, and is supported by stiffeners 240. A ladder 250 can be connected to enable personnel to climb from the ground 110 to the deck 230. The deck 230 provides a weapons platform within a periphery bounded by a railing fence 260. The deck 230 includes a hole mesh on its surface to facilitate attachments of auxiliary equipment, such as a gun turret 270 that pivots a gun carriage 280 mounting a weapon 290, such artillery (e.g., gun or mortar). These fixture components are identified in context to the vehicle assembly in FIG. 3, which shows a detail perspective view 300 of the gun platform 190 deposited on the flat bed 150. An exemplary weapon 290 constitutes, for example, a Recoiling Mortar System RMS 6-G or else an RMS 6-L.

A dynamic Finite Element Analysis (FEA) has been performed on the M1083 truck to determine whether the vehicle's frame and suspension system could withstand the EMTAS or RMS 6L (120 mm Mortar) 40 metric ton recoil forces when fired off the top of the flat bed 150. The analysis shows that the recoil forces are too intense to avoid damage to that the frame structure upon weapons discharge the exemplary embodiments. Thus, reinforcement becomes necessary underneath the weapon system in order to transmit the forces directly to the ground 110 without depending on the vehiclets structure. Also the reaction of the recoil forces is so rapid that the suspension system cannot react in time and the shocks of the system would bottom out and suffer severe damage. A static Finite Element Analysis (FEA) was performed on the exemplary MMWPFS using the Structural Steel (ASTM-A36) series steel, and the results were acceptable. The exemplary gun platform 190 can withstand approximately 40 metric tons of recoil forces.

Human system integration provides the fence 260 to reduce personnel hazard from falling off the deck 230 and the ladder 250 to enable an operator to climb onto the deck 230 or the flat bed 150. The deck 230 has several hole mounts on its surface 510 in order to accommodate any rail or weapon system that could withstand the recoil forces when fired therefrom (e.g., 81 mm, 120 mm Mortar, 2.75 rocket motor 19/7 tube launcher, Small UAV Drone, or else a base as a lookout tower by using armor instead of the fence 260).

Figure 4A:
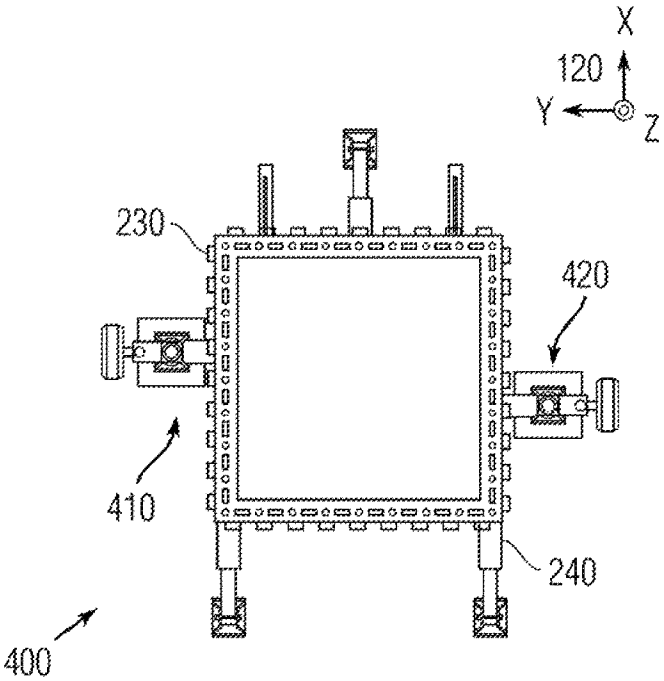
FIG. 4A is a plan view of the shock absorption stand.
Figure 4C:
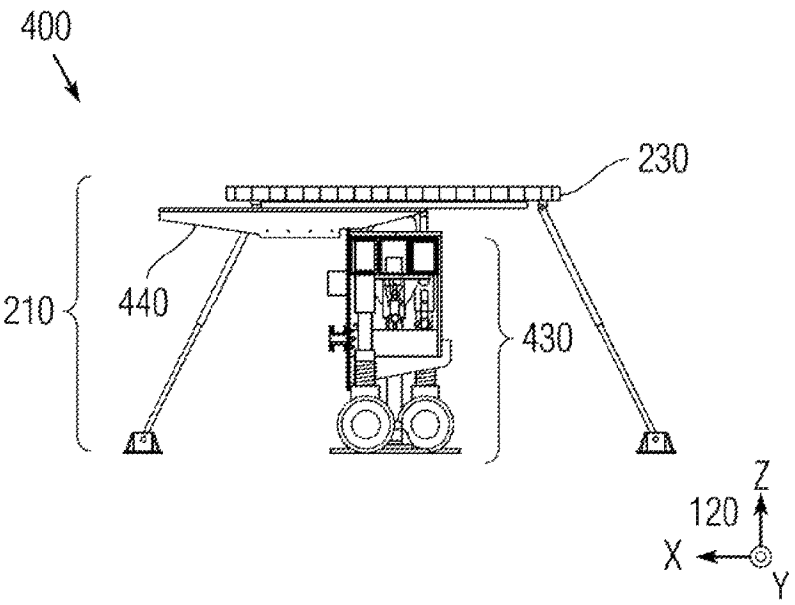
FIGS. 4B and 4C are elevation views of the shock absorption stand.
Figure 4B:
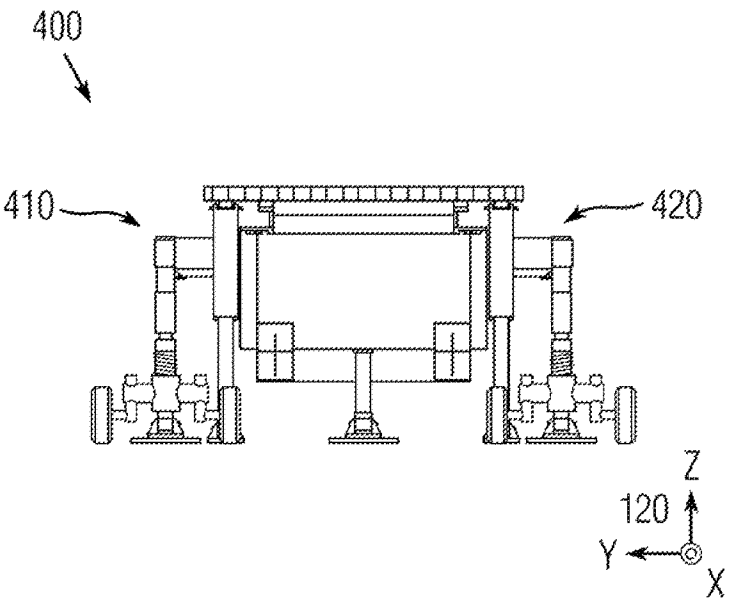
Figure 5B:
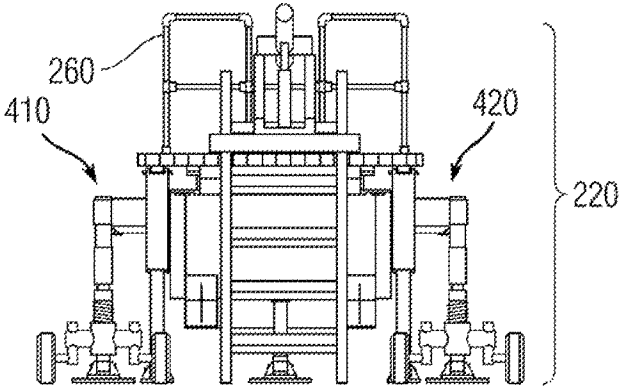
FIGS. 5B and 5C are elevation views of the platform fixture.
Figure 5C:
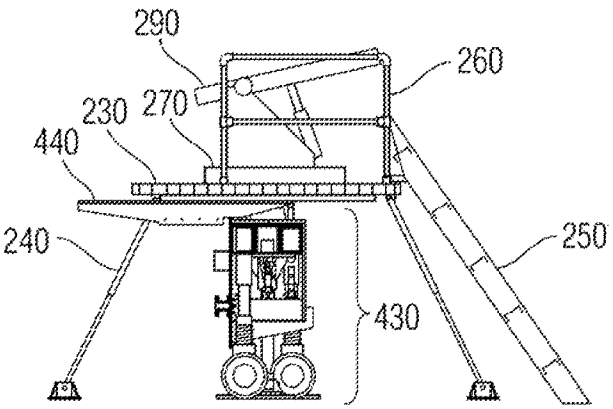
Figure 5A:
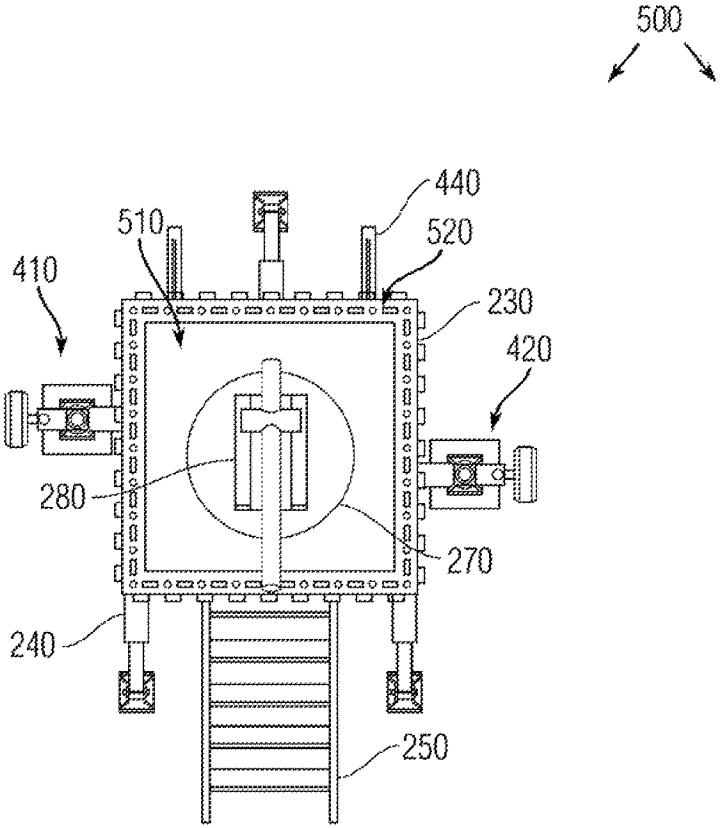
FIG. 5A is a plan view of the platform fixture as deployed.

FIGS. 4A through 4C show plan (FIG. 4A) and elevation (FIGS. 4B and 4C) assembly views 400 of the fixture stand 210 featuring port 410 and starboard 420 outriggers as deployed. A recoil support 430 and a slider assembly 440 are disposed below the deck 230. FIGS. 5A through 5C show plan (FIG. 5A) and elevation (FIGS. 5B and 5C) assembly views 500 of the assembly platform 220 similar to the fixture views 400 while also including the weapon superstructure 180. The deck 230 includes its platform surface 510 featuring a mesh pattern of holes for fastening components thereto as well as peripheral holes 520 for attaching the fence 260.

Figure 6A:
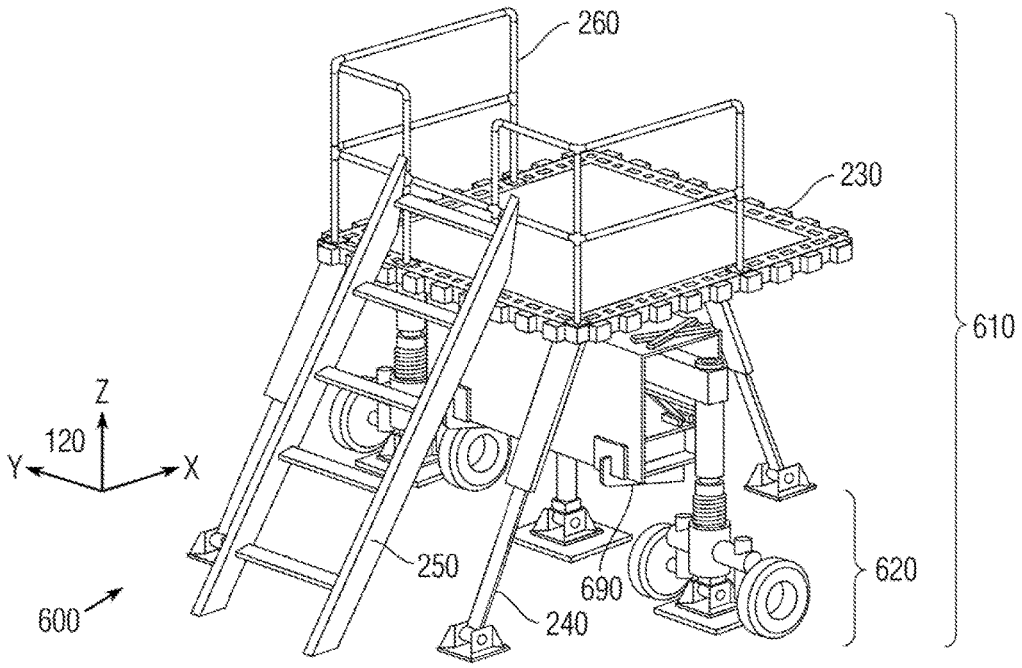
FIG. 6A is a perspective assembly view of the platform fixture.
Figure 6B:
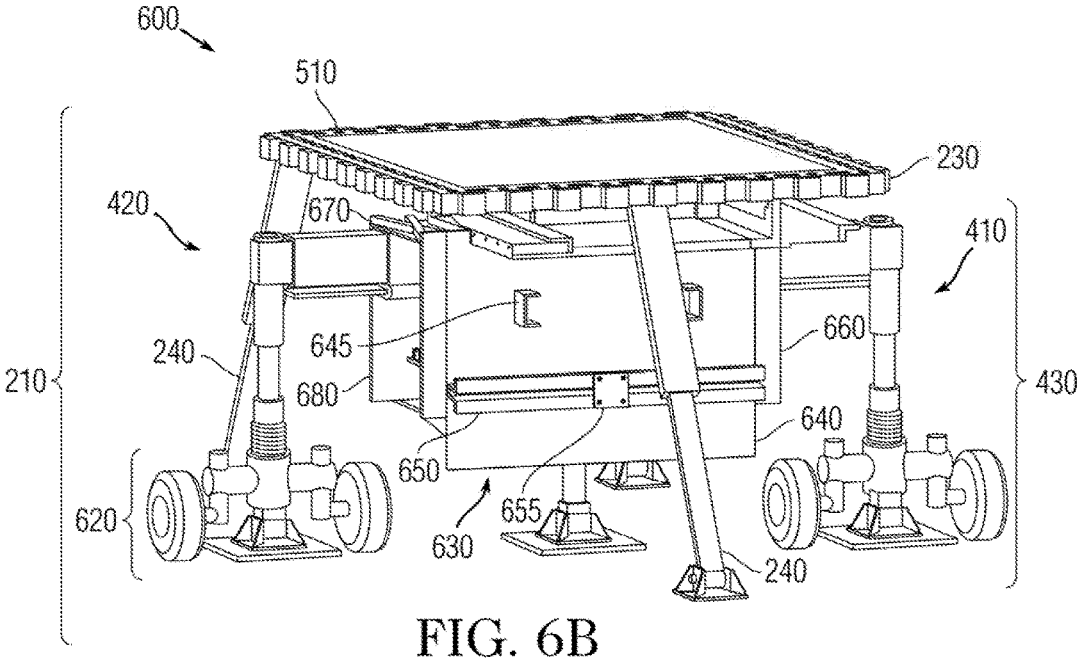
FIG. 6B is a perspective view of the shock absorption stand.

FIGS. 6A and 6B show isometric assembly views 600 of a stand platform 610 (without the turret 270) and the fixture stand 210, including the slider assembly 440 and the recoil support 430, which includes the port and starboard outriggers 410 and 420, each with a detachable wheel housing 620 that engages the ground 110. A shock-absorbing assembly 630 under the slider assembly 440 includes a front plate 640 onto which laterally disposed brackets 645 and a rail 650 attaches. The rail 650 further includes a towing hitch 655. A brace plate 660 adjoins a bridge plate 670 that extends horizontally aft from the front plate 640 until reaching, a rear plate 680. A pair of brackets 690 secures the vertical plates 640, 670 and 680 from independent oscillation.

The turret 270 can be installed on the deck 230 with little or no modification to attach and transport the Mobile Modular Weapon Platform Fixture System (MMWPFS) with an existing military vehicle for Marine (MTVR), Army (FMTV), or Air Force (tri-service) ground transport. The removable stiffeners 240 attached to the deck 230 enable the vehicle 130 to move and separate from the MMWPFS on the gun platform 190 for ready installation. The MMWPFS on the exemplary gun platform 190 provides a stand platform 610 for integration with the vehicle 130. The exemplary embodiments enable weapon operation directly with or away from the vehicle 130, as well as withstand the weight and recoil forces of the weapon 290 without damage to platform 190, cradle 280 or vehicle 130.

The principal feature of the exemplary MMWPFS is the ability to utilize the mass of the top carriage to moderate double recoil forces. Two recoil systems are, involved the primary system of the weapon 290, which is directly affected by the dynamic of the round and the secondary system of the carriage 280 that controls the impetus of the weapon 290. This gun platform 190 has the flexibility for operating the weapon 290 while mounted directly to varieties of military vehicle 130 and also independently, withstanding the weight and recoil forces to prevent damage to the deck 230.

Figure 7:
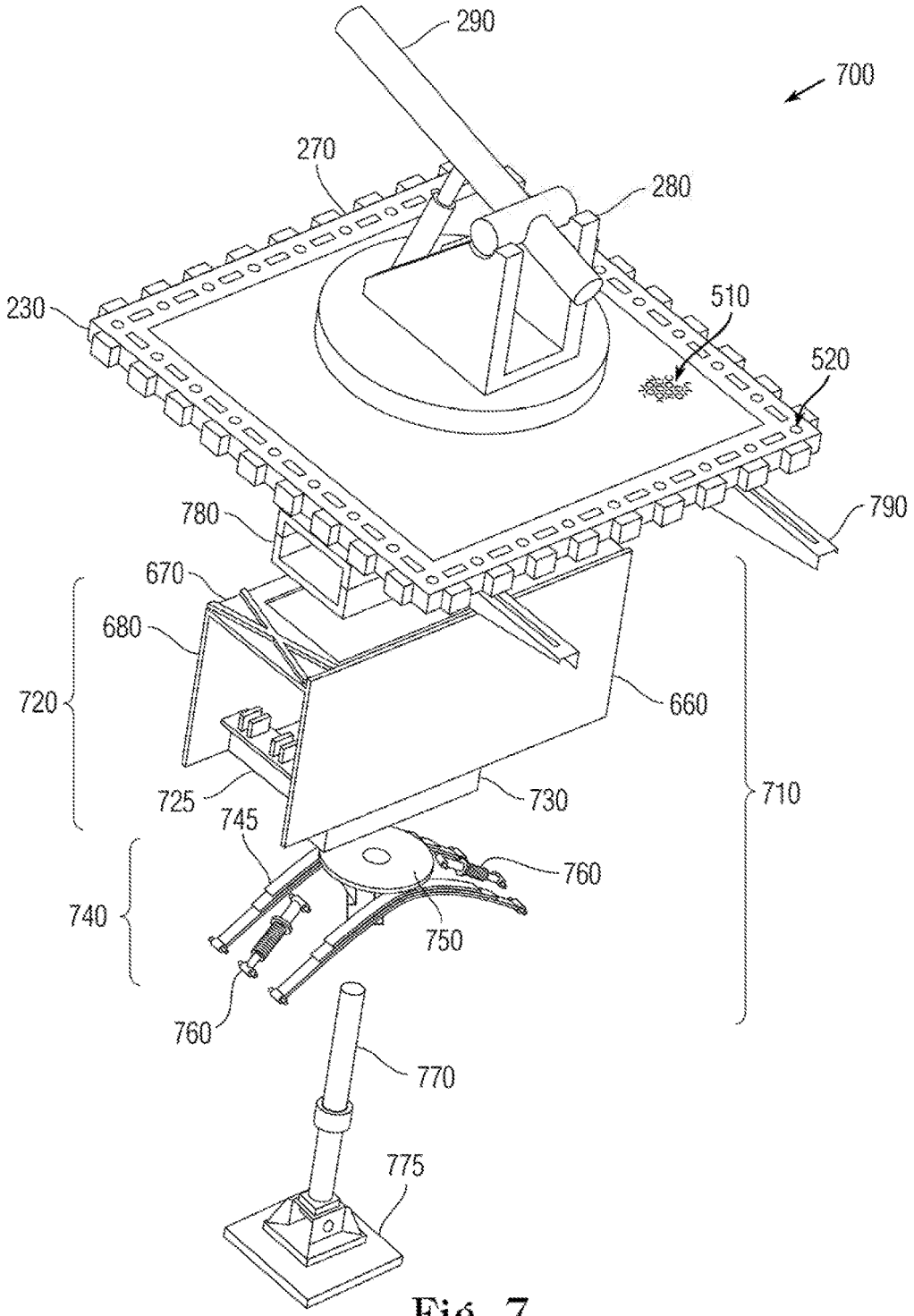
FIG. 7 is a perspective exploded view of platform fixture components.

FIG. 7 shows an isometric exploded view 700 of the recoil support 430 excluding the lateral outriggers 410 and 420. A base set 710 of shock absorbing components for the assembly 630 is disposed below the slider assembly 440 beneath the deck 230. The set 710 includes a vibration dampener housing 720 bounded by the brace and rear plates 660 and 680. The dampener housing 720 houses a pair of bridge mounts 725, a brace box 730, and a bridge assembly 740 with a pair of parallel leaf springs 745, an axi-symmetric yoke 750, and a pair of shock absorbers 760. The assembly 630 further includes a base post 770 with a recoil pad 775 that engages the ground 110. The upper end of the base post 770 inserts through the yoke 750 inside the dampener housing 720. The slider assembly 440 includes a slider box 780 disposed laterally and pair of rails 790 extending in the longitudinal direction.

Figure 8A:
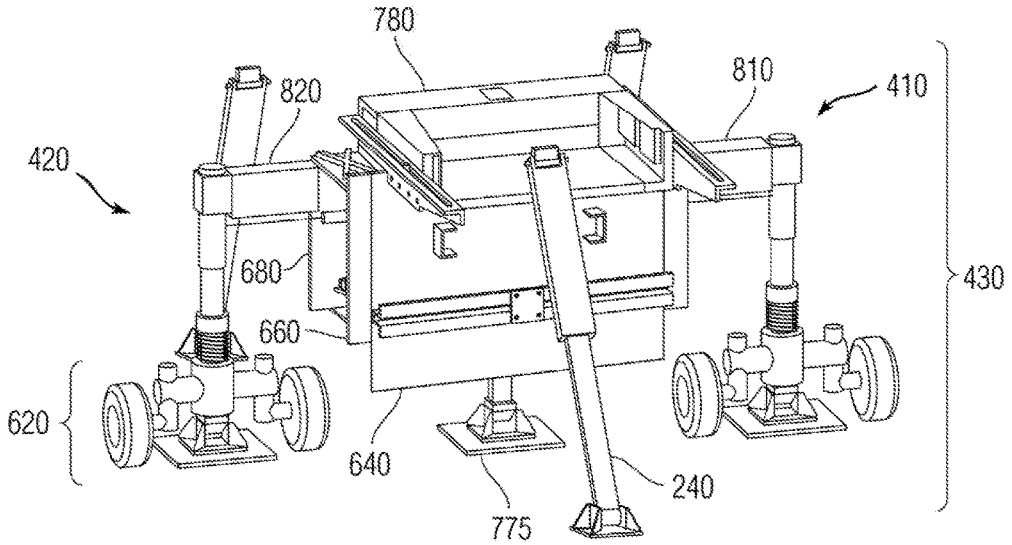
FIGS. 8A, 8B and 8C are perspective views of the shock absorption stand absent the mounting deck.
Figure 8B:
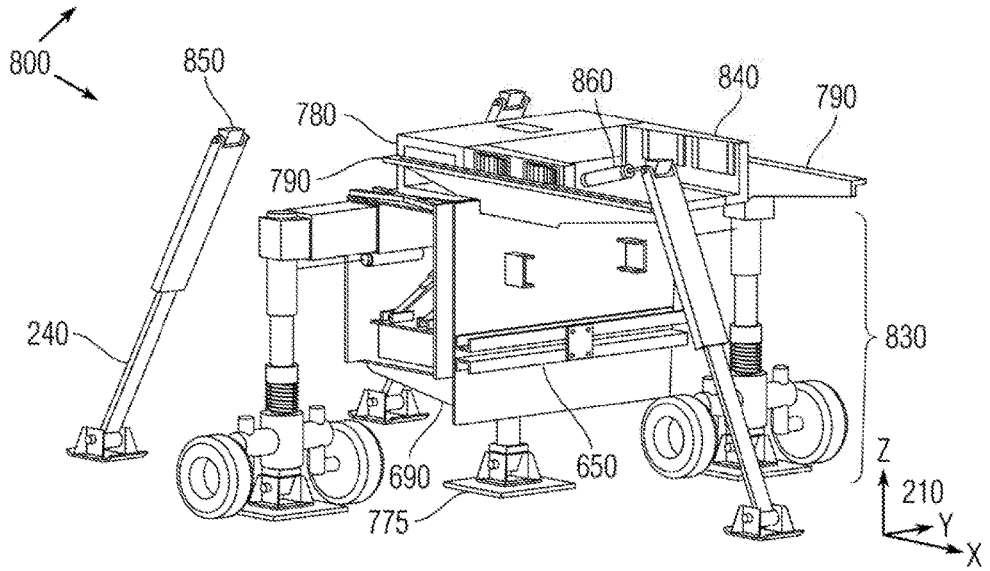
Figure 8C:
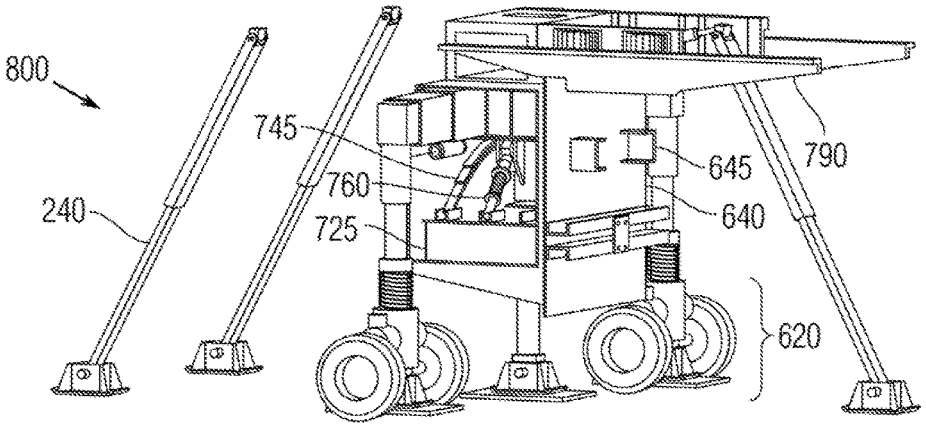

FIGS. 8A, 8B and 8C show isometric assembly views 800 of the recoil support 430 absent the deck 230. The port and starboard outriggers 410 and 420 flank the shock absorbing assembly 630. The port outrigger 410 includes a proximal (or fore) telescoping arm 810 extending laterally leftward from the dampener housing 720. The starboard outrigger 420 includes a distal (or aft) telescoping arm 820 extending laterally rightward from the dampener housing 720. Each outrigger includes a terminal post assembly 830, each with a base post 770 ending in a recoil pad 775. In addition to the slider box 780 and rails 790, the slider assembly 440 further includes a slider bracket 840. A hinge joint 850 connects each stiffener 240 to a linear actuator 860, which attaches to the deck 230.

Figure 9:
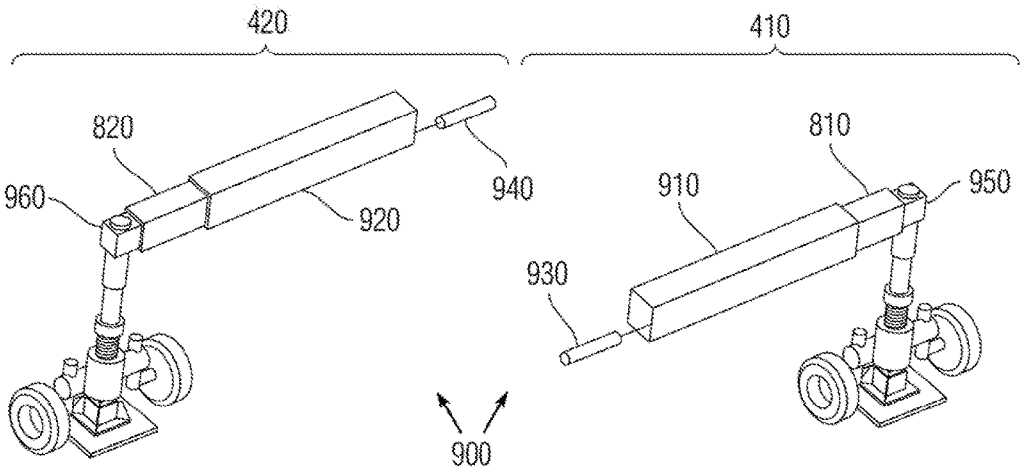
FIG. 9 is a set of perspective views of outriggers.

FIG. 9 shows isometric views 900 of the outriggers 410 and 420. The port outrigger 410 includes a fore sleeve 910 into which the proximal telescoping arm 810 inserts or extends therefrom. The starboard outrigger 420 includes an aft sleeve 920 into which the distal telescoping arm 820 inserts or extends therefrom. The sleeves 910, 920 and corresponding arms 810, 820 constitute the respective beams of the port and starboard outriggers 410, 420. The port and starboard outriggers 410 and 420 each further include respective linear actuators 930 and 940 to extend or retract the corresponding arms 810 and 820 out of or into their associated sleeves 910 and 920 prior to lowering their associated base posts 770 so their wheel assemblies 620 reach the ground 110.

Figure 10A:
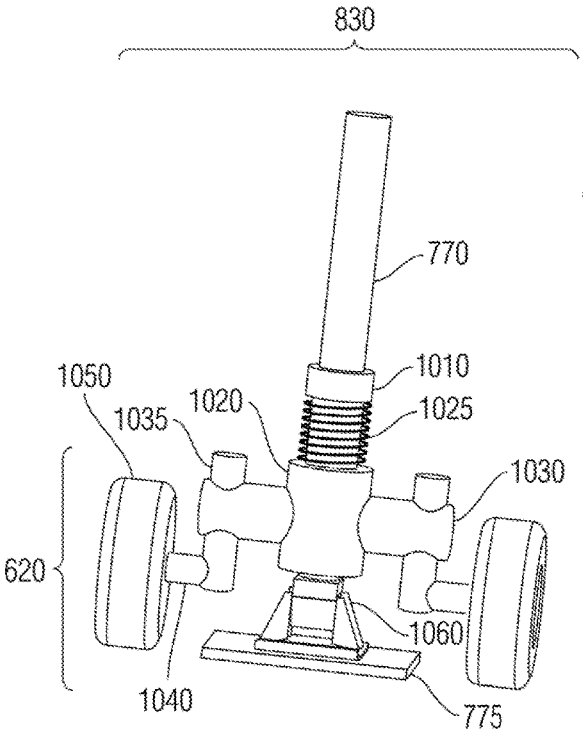
FIGS. 10A and 10B are perspective views of respective outrigger posts and stiffeners.
Figure 10B:
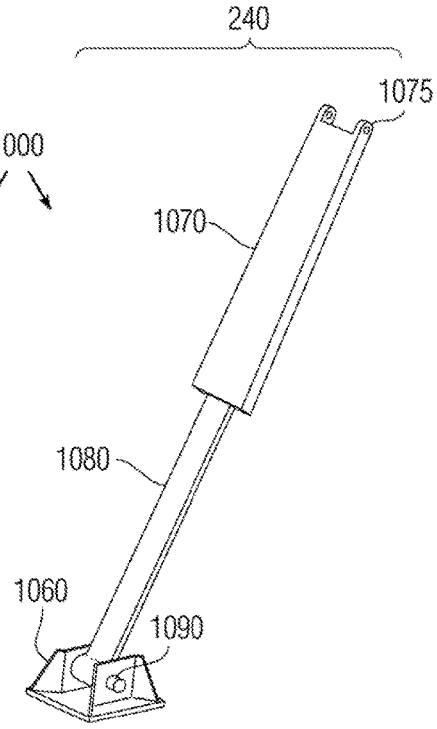

FIGS. 10A and 10B shows isometric views 1000 of the terminal post assembly 830 for the outriggers 410 and 420 and the stiffener 240. The post assembly 830 includes a base post 770 with a collar 1010 and a trunk 1020 with a helical spring 1025 disposed therebetween. For the wheel housing 620, lateral branches 1030 splay outward from the trunk 1020. A pair of stems 1035 extends downward from the branches 1030 to support laterally extending axles 1040 onto which tires 1050 attach for ground 110 engagement. A shoe 1060 secures the base post 770 to the pad 775, The stiffener 240 includes an upper flange 1070 ending in a clevis 1075 that hinges to the joint 850, and a lower flange 1080 that telescopes into the upper flange 1070 to adjust the stiffener's length. A pin 1090 attaches a shoe 1060 to the lower flange 1080 for engaging the ground 110. The assembly platform 220 typically includes three stiffeners 240 when deployed.

Figure 11:
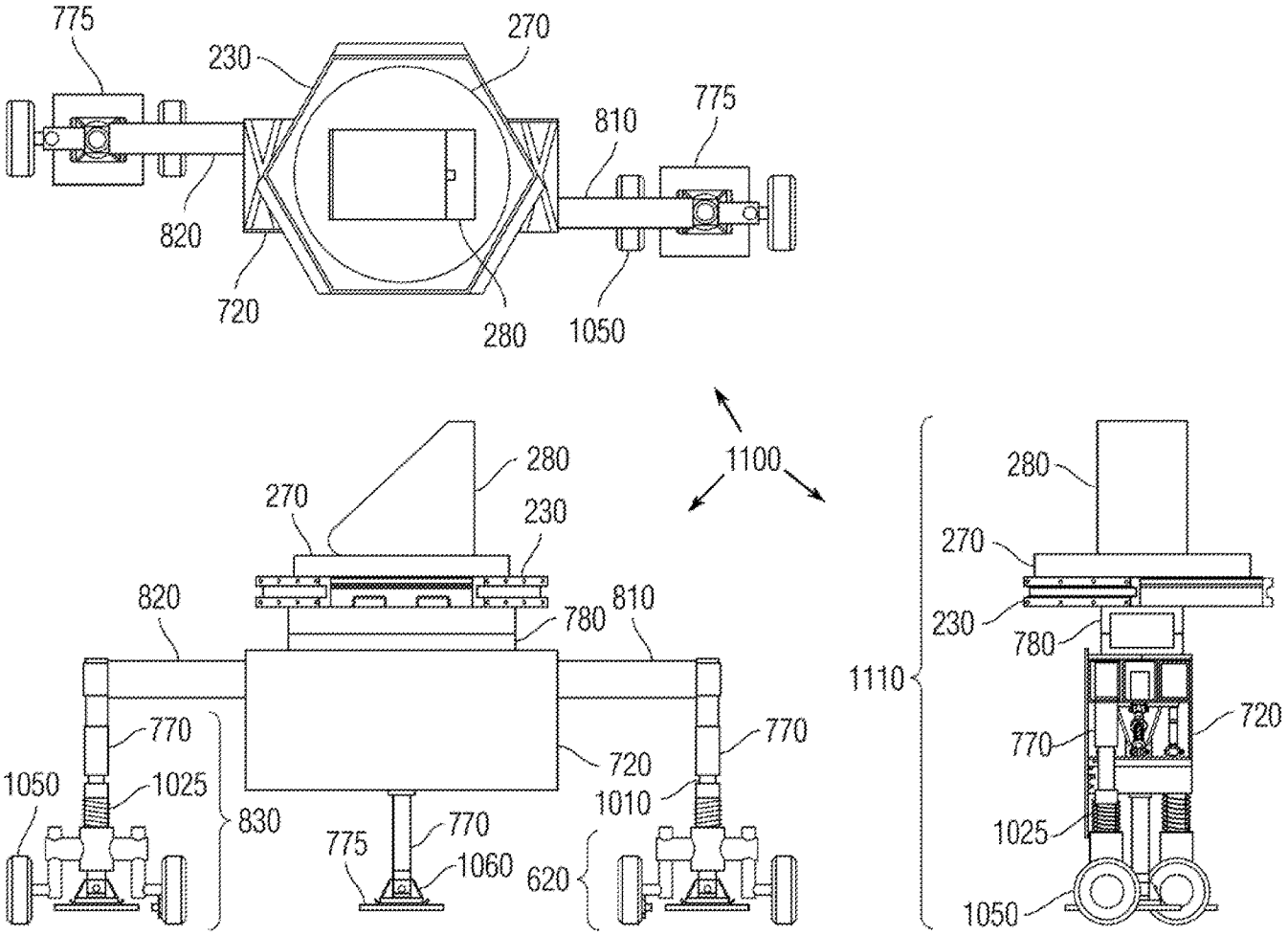
FIG. 11 is a set of plan and elevation views of the platform fixture.

FIG. 11 shows plan and elevation views 1100 of the assembly platform 1110 with select components excluded for clarity and the deck 230 displayed as a hexagonal cross-sectional portion onto which the turret 270 and carriage 280 are mounted. The outer base posts 770 at the terminals of the outrigger arms 810 and 820 each include the wheel housing 620 below the spring 1025 with the tires 1050 shown from view 1000. The center base post 770 that extends into the dampener housing 720 lacks the wheel housing 620.

Figure 12:
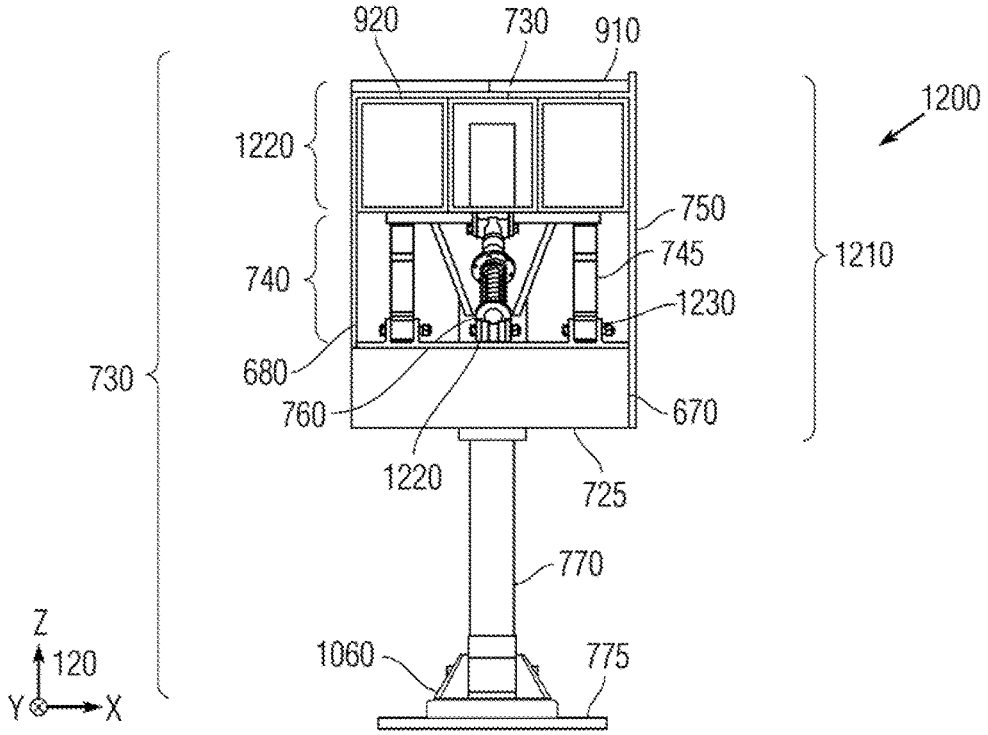
FIG. 12 is an elevation view of a shock absorbing center module.

FIG. 12 shows an elevation assembly view 1200 of the shock absorbing assembly 630, facing the port side looking starboard, with the components of dampener housing 720 connected together as the vibration damper 1210. The base post 770 (without a wheel housing 620) inserts into the yoke 750. The vibration damper 1210 includes an alto chamber 1220 and bridge assembly 740. The alto chamber 1220 houses the box brace 730, which is flanked by the fore and aft sleeves 910 and 920 for their corresponding port and starboard outriggers 410 and 420, respectively. The bridge assembly 740 houses the bridge mounts 725 with clevis joints 1220 and 1230 respectively for the shock absorbers 760 and the leaf springs 745.

Figure 13A:
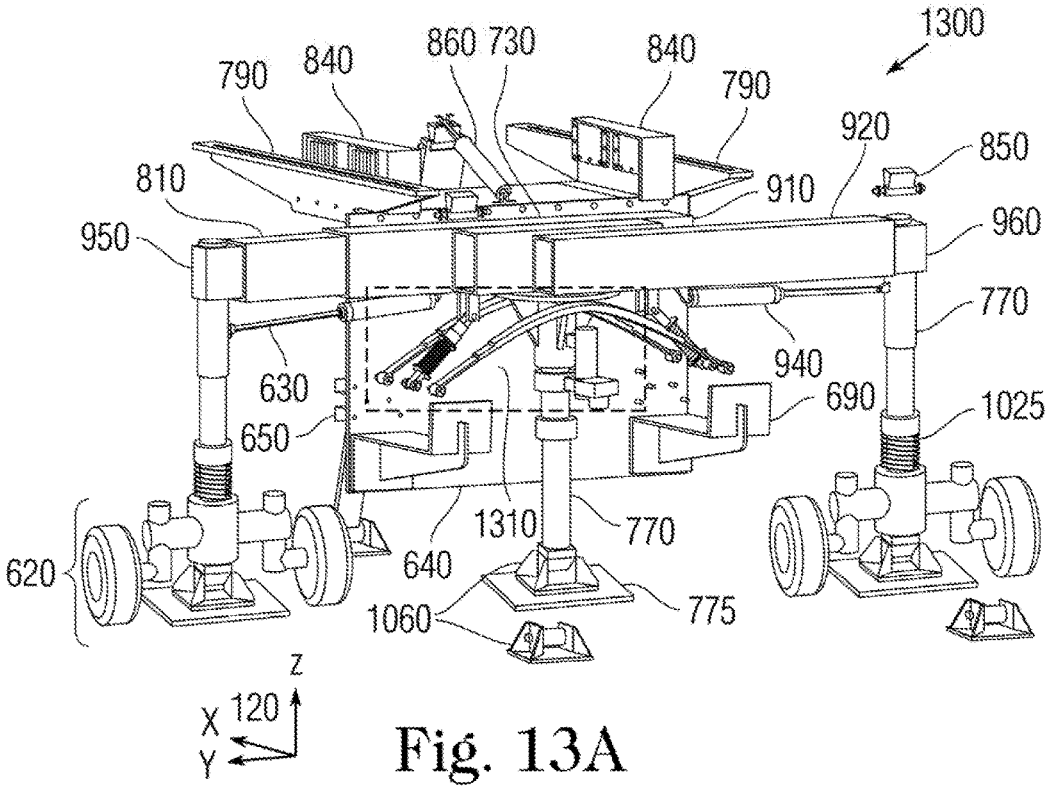
FIG. 13A is a perspective cutaway view of the shock absorbing stand.
Figure 13B:
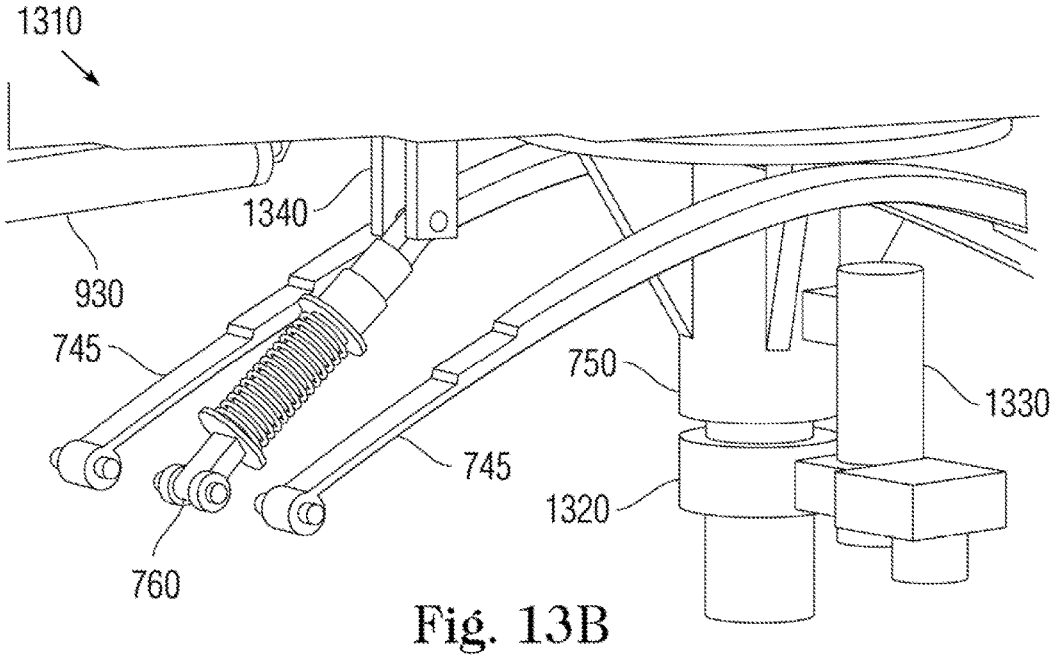
FIG. 13B is a detail perspective cutaway view of the center module.

FIG. 13A shows an axial cutaway view 1300 of the fixture stand 220, while FIG. 13B shows a detail perspective view 1310 of the bridge assembly 740. A retaining clamp 1320 envelopes the center base post 770 within a radial notch below the yoke 750. A retaining clamp actuator 1330 restrains the post 770 in stowage by imposing force on the clamp 1320 from the rear plate 680. The shock absorbers 760 attach to the yoke 750 by flanges 1340, while the leaf springs 745 push vertically upward against the yoke 750.

Figure 14:
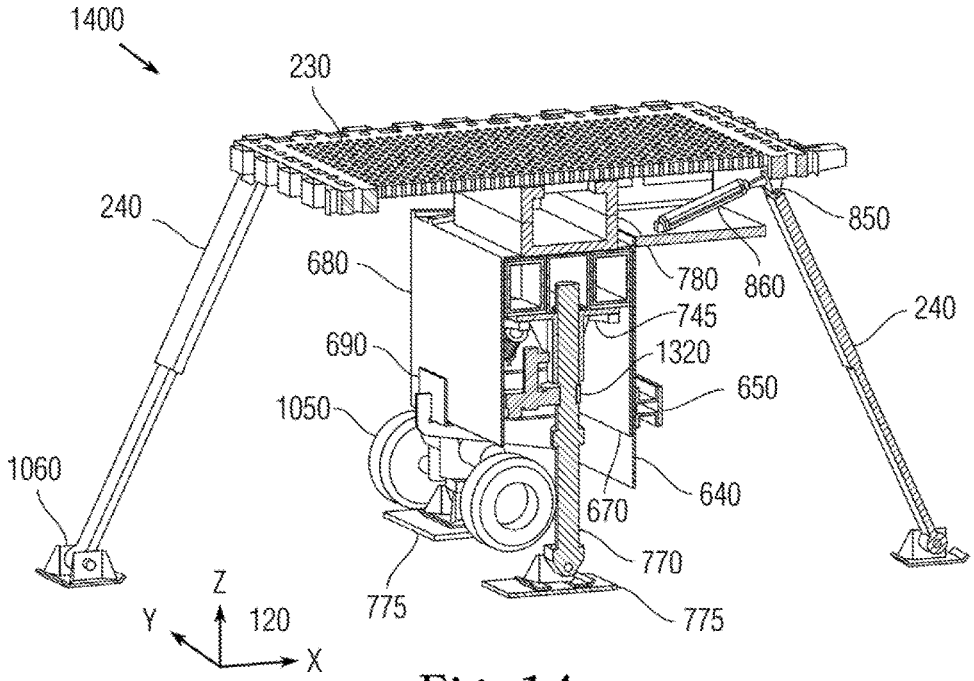
FIG. 14 is a perspective cutaway view of the platform fixture.
Figure 16:
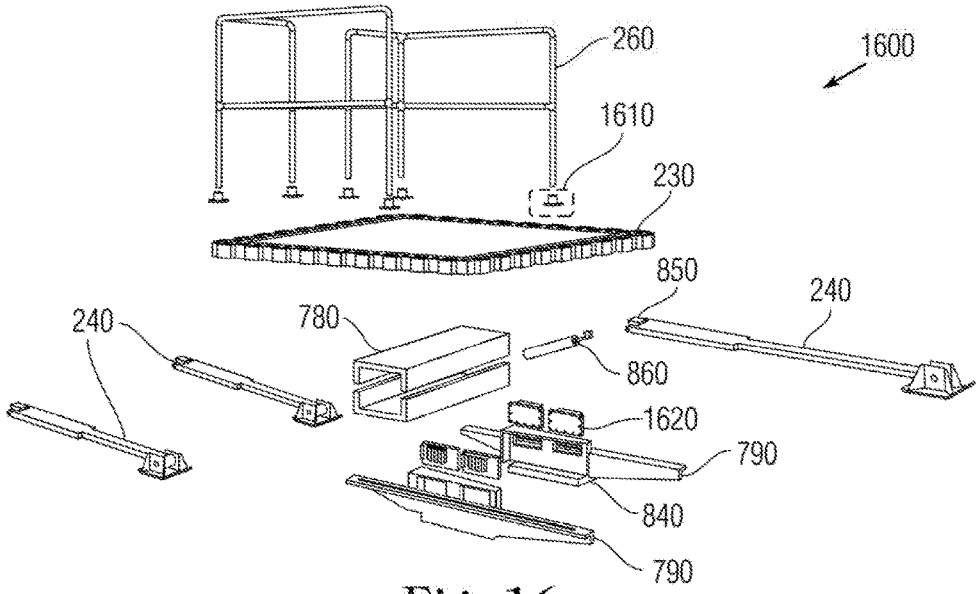
FIG. 16 is a perspective cutaway view of the upper portion of the platform fixture.
Figure 15A:
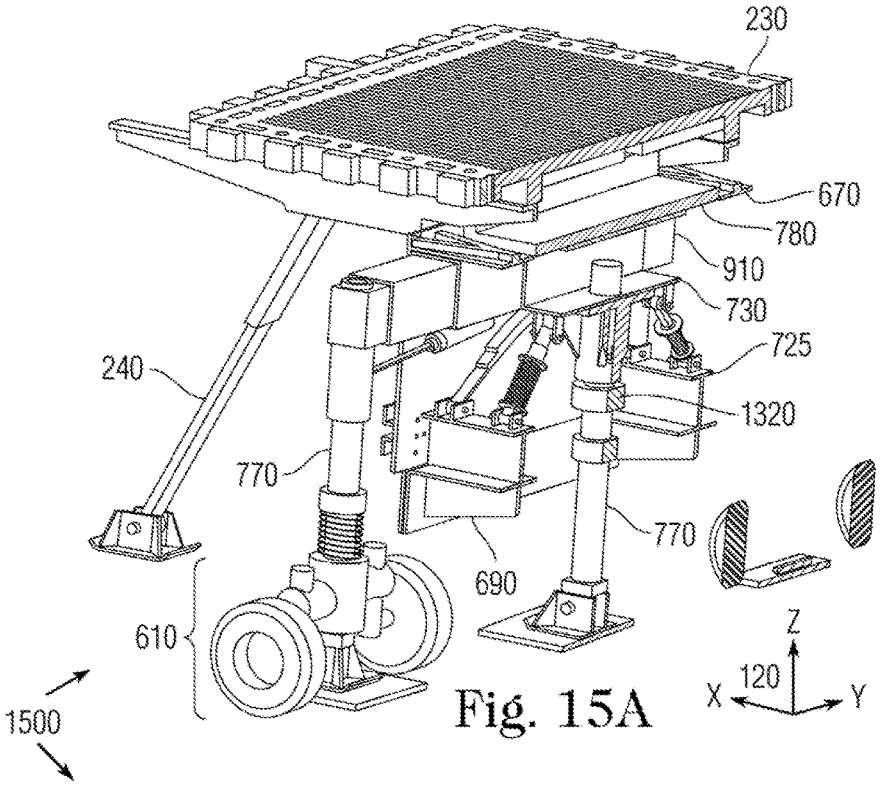
FIGS. 15A and 15B are perspective cutaway views of the platform fixture.
Figure 15B:
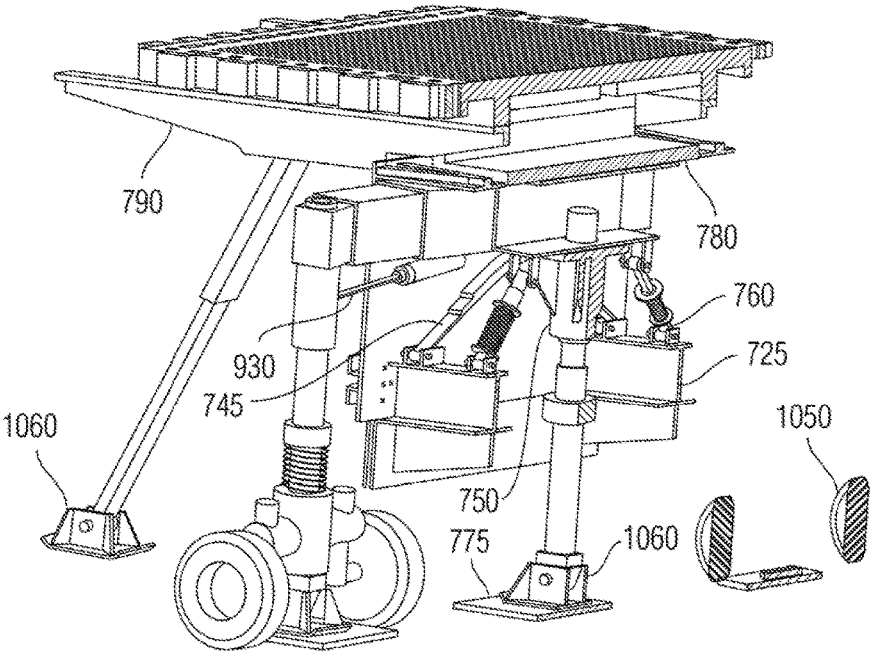

FIG. 14 shows a lateral cutaway perspective view 1400 of the components of the assembly platform 230. The fence 260 attaches to the deck 230 by fastening sockets 1610 at the end of the fence's vertical members to the deck's peripheral holes 520. In addition to the slider box 780, rails 790 and bracket 840, the slider assembly 440 includes, inserts 1620 to the brackets 840. The actuators 860 attaching to the stiffeners 240 are also displayed. FIGS. 15A and 15B show axial cutaway views 1500 of the assembly platform 220. The brackets 690 extending between the plates 660 and 680 support the bridge mounts 725, which braces the shock absorbers 760 and leaf springs 745. FIG. 16 shows an exploded perspective view 1600 of the components of the deck 230 and slider assembly 440. The fence 260 attaches to the deck 230 by fastening sockets 1610 at the end of the fence's vertical members to the deck's peripheral holes 520. In addition to the slider box 780, rails 790 and bracket 840, the slider assembly 440 includes, inserts 1620 to the brackets 840. The actuators 860 attaching to the stiffeners 240 are also displayed.

Figure 17A:
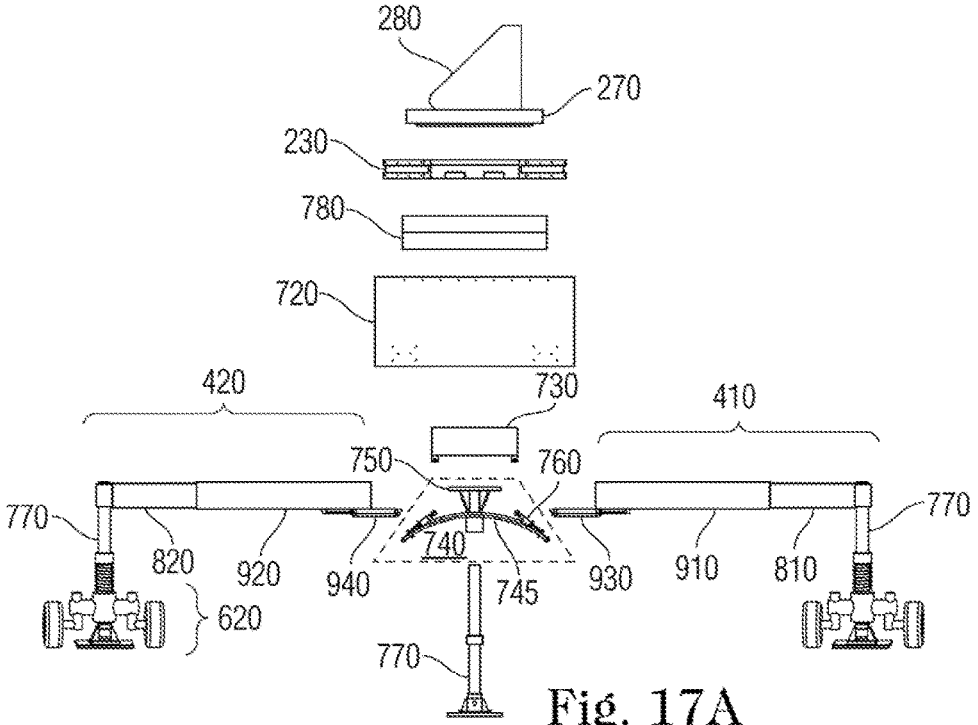
FIGS. 17A and 17B are elevation and perspective exploded views of the platform fixture.
Figure 17B:
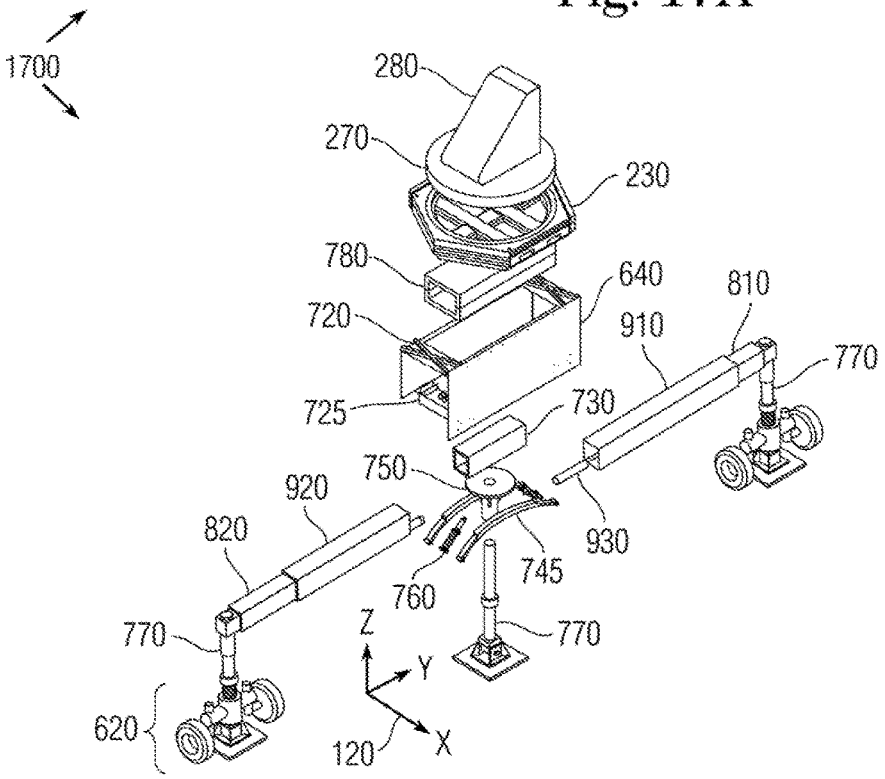

FIGS. 17A and 17B respectively show elevation and isometric exploded views 1700 of the components of the assembly platform 220 with the deck 230 truncated to a hexagonal section for visual facility (as in view 1100). The turret 270 with carriage 280 are shown above the deck 230, while the slider box 780 is shown underneath and above the dampener housing 720 that houses the brace box 730 as well as the outrigger sleeves 910 and 920 and the bridge assembly 740. The sleeves 910 and 920 of their respective outriggers 410 and 420 attach to respective arms 810 and 820 supported by associated base posts 770 and their wheel housings 620.

The slider and brace boxes 780 and 730 reinforce longitudinal stability against sudden forces from firing the weapon 290. The extension arms 810 and 820 extend parallel and adjacent to these boxes 780 and 730 with a dampener housing 720 therebetween oriented substantially along the lateral direction. The recoil support 430 supports the deck 230. Forward of the slider box 780, extendible slide rails 790 attach to the bracket 870 on either side of the support 430 oriented parallel to the longitudinal direction. Vertical plates 670 and 680 bound the dampener housing 720 of the recoil support 430. The outriggers 410 and 420 extend from the upper chamber 1220 of the dampener housing 720.

The base posts 770 engage the ground 110 by recoil pads 775 and are lengthwise adjustable for vertical retraction and extension. The slider and brace boxes 780 and 730, the outrigger arms 810 and 820, and the outrigger sleeves 910 and 920 have rectangular cross-sections and are composed of steel. The vertical plates 640, 670 and 680 also comprise steel, as do the posts 770.

Figure 18A:
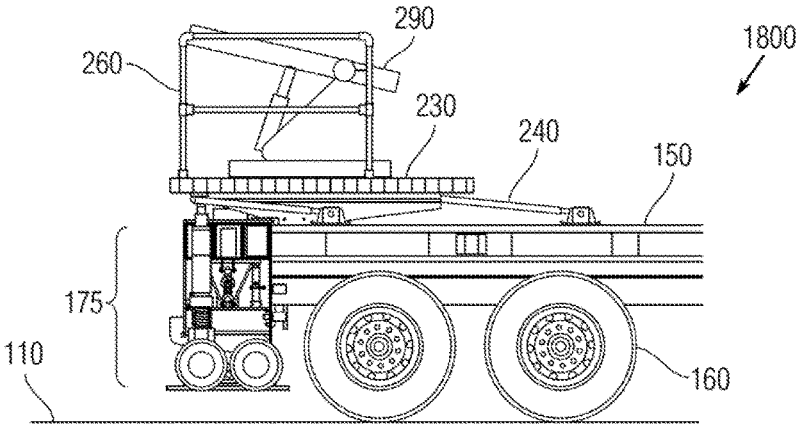
FIGS. 18A, 18B, 18C and 18D are elevation views of the truck and platform fixture from stowage to deployment.
Figure 18B:
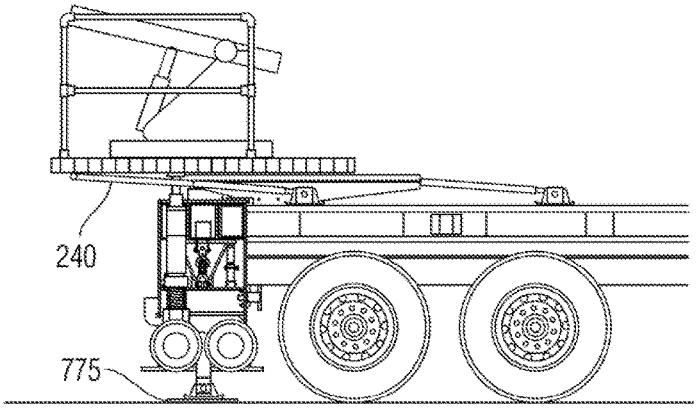
Figure 18C:
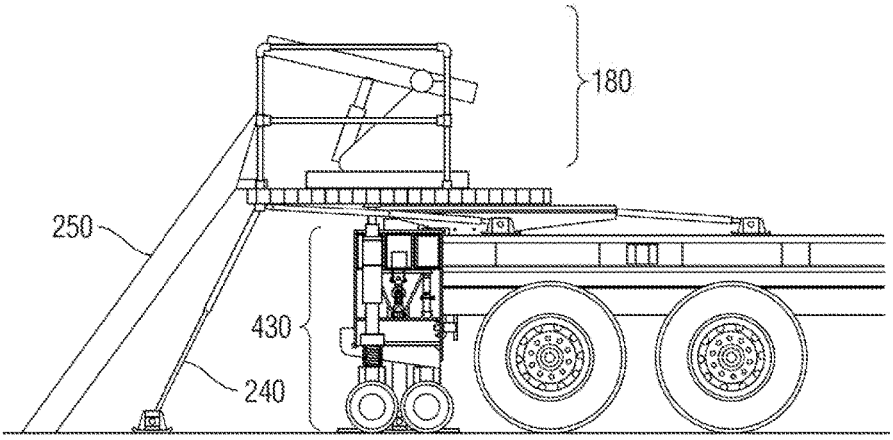
Figure 18D:
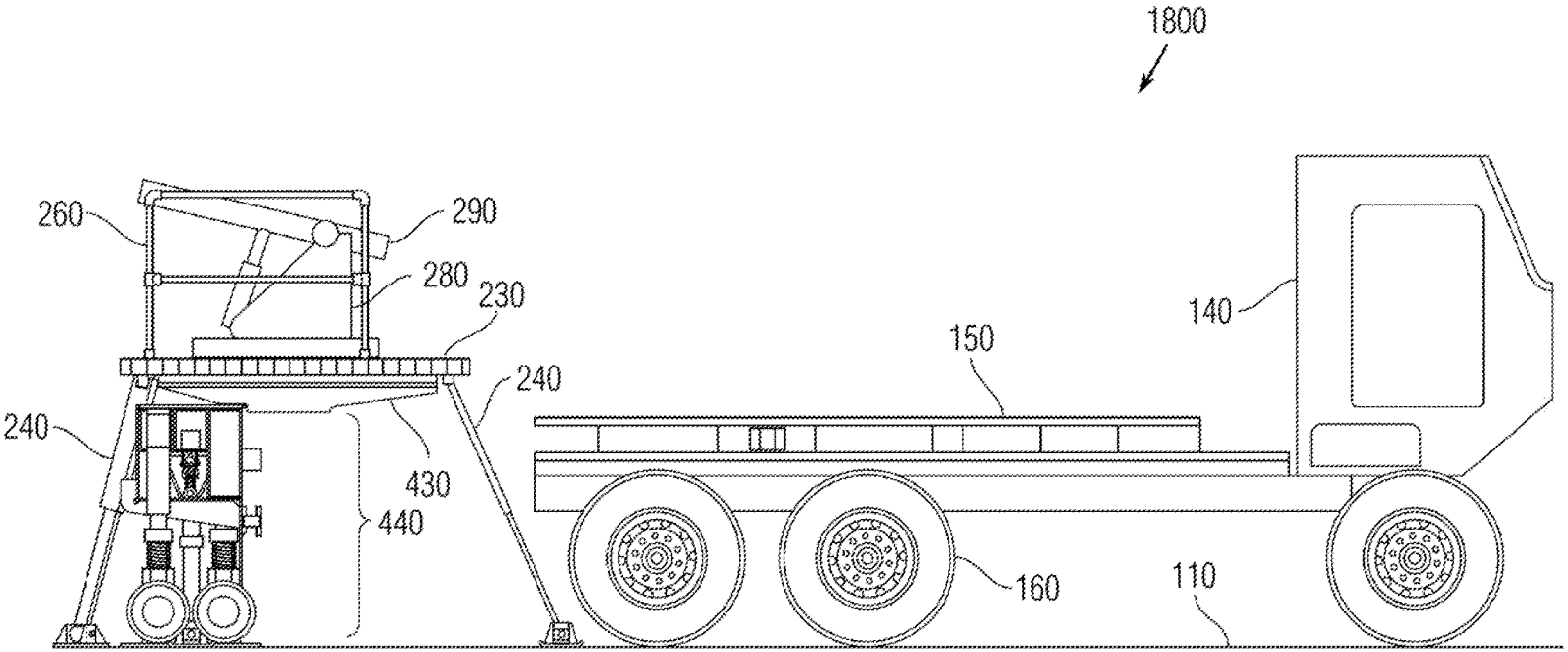

FIGS. 18A, 18B, 18C and 18D show lateral elevation views 1800 of the vehicle 130 with the exemplary platform 190. FIG. 18A shows the stowed platform 190 attaching to the vehicle 130 with base posts 770 retracted for road transport. FIG. 18B shows the deployed platform 220 the base posts 770 extended, with the wheels 160 elevated slightly off the ground 110. FIG. 18C shows the stiffeners 240 engaged between the deck 230 and the ground 110, and the ladder 250 installed. FIG. 18D shows the vehicle 130 driving away leaving the platform 190 deployed in position (with the rear stiffeners splayed outward, as provided in an alternate configuration).

The compass rose 120 shows the orientation of the vehicle 130 facing to the right (and port away from the viewer). The stiffeners 240 and posts 770 elevate the wheels 160 off the ground 110 and dispose the deck 230 a specified vertical distance (e.g., 73.93 inches) therefrom. The deck 230 slideably connects to the flat bed 150 by the slide assembly 440 and elevated from the ground 110 by the recoil support 430. The stiffeners 240 attach to the deck 230, such as at the peripheral holes 520 that can connect and detach as needed, The typical setup time when transporting and using the MMWPFS to fire the weapon (e.g., mortar) 290 is reduced approximately by half (ground fire or attached to vehicle 130). Also the exemplary gun platform 190 can be attached or carried on the rear of a government vehicle for rapid transportation and operation for a Forward Operating Base (FOB). Each individual base post 770 can be operated manually using hand cranks and gears, or else hydraulically or with an electric motor. The deck 230 can be pushed in and retracted up by turning the winch on the vehicle 130 such as a jack or hoist.

Conventionally, no currently fielded platforms enable a large weapon system to: 1) be easily transported on a variety of vehicles; 2) fire while being transported; and 3) fire from the ground 110 without major alterations. Conventional systems enable large weapon systems to be either ground fired or vehicle fired, but not both. The ground fired systems are also unable to be used while being transported.

Exemplary embodiments enable the weapon 290, e.g., mortar, to be fired from the vehicle 130 during transport without dismounting. The deck 230 can be adjusted vertically by approximately 5 inches from the ground 110. An integrated weapon system adds approximately 4 feet to each of these values (6 feet from the ground 110 or 9 feet from the ground 110 when fired on the flat bed 150 of the vehicle 130). For the weapon 290 firing from the rear of the vehicle 130, the gun platform 190 can receive all the recoil force for absorption and transfer to the ground 110. Analysis on the EMTAS and MMWPFS was performed using the 5-ton truck (M1083) Family Medium Tactical Vehicle (FMTV) family. The RMS6-G Recoil Mortar (EMTAS) can be fired off the fixture or off the top of a flat bed 150 of the vehicle 130.

The recoil platform 430 provides spring action to absorb some of the recoil forces transmitted from the weapon 290 (in x, y and z directions) that are then reduced through recoil containment plates 640, 670 and 680, designed to mitigate these forces by transmitting these to the ground 110. Within and between these vertical plates 640, 670 and 680, this recoil containment constitutes an array of components operating together in unison (e.g., springs, shock absorbers, rubber mounts, etc.) to absorb that vibrational energy. The pair of laterally extendable arms 810 and 820 assists to stabilize the vehicle 130 and the exemplary platform 190 when firing the weapon 290.

A triplet of vertically adjustable recoil posts 770 (i.e., two at the distal ends of the outrigger beams and one in the center) level the MMWPFS system. These posts 770 are adjustable to different heights to act as a strong column in transmitting all the recoil forces to the ground 110. Three recoil pads 775 receive the recoil forces from the posts 770 and distribute those forces to the ground 110. The three sets of retractable stiffeners 240 and their shoes 1090 to engage the ground 110 provide stability for the MMWPFS and the vehicle 130 in the longitudinal and lateral directions when the weapon 290 is fired.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A fixture configured to provide load support from weapons recoil and configured to be mounted on a flat bed of a road vehicle disposed on ground, said flat bed able to receive a weapons mount, said vehicle having longitudinal, lateral and vertical orientation directions, said fixture comprising:

a horizontal deck configured to receive the weapons mount;

a slide assembly configured to support said deck, said slide assembly disposable on the flat bed;

a dampener housing attached to said slide assembly;

port and starboard outrigger beams that extend laterally from said dampener housing, each of said port and starboard outrigger beams having a proximal end and a distal end respectively, said proximal end telescopically inserting into said dampener housing;

a first post and a second post extending vertically downward from said distal ends of said outrigger beams, respectively, to engage the ground; and a third post that extends vertically downward from said dampener housing to engage the ground, wherein said posts are configured to retract for stowage and said posts are configured to extend to raise the flat bed above the ground;

wherein said dampener housing further includes:

a horizontal bridge plate that attaches under said slide assembly;

fore and aft vertical plates that attach under said bridge plate;

port and starboard brackets connecting said vertical plates below said bridge plate;

a yoke disposed between said vertical plates and through which said third post passes;

port and starboard shock absorbers respectively hinged to mounts on said port and starboard brackets, and said port and starboard shock absorbers respectively hinged to said yoke; and, fore and aft leaf springs respectively hinged to said port and starboard brackets for engaging said yoke.

2. The fixture according to claim 1, wherein each of said first, second and third posts includes a pad to engage the ground.

3. The fixture according to claim 1, further comprising:

a plurality of stabilizing stiffeners attachable to said deck and extending to the ground.

4. The fixture according to claim 3, wherein each stiffener of said plurality of stabilizing stiffeners further includes a shoe for engaging the ground.

5. The fixture according to claim 1, said port and starboard outrigger beams are disposed respectively forward and aft of said dampener housing.

6. The fixture according to claim 1, wherein said dampener housing further includes a brace box disposed parallel to and longitudinally between said outrigger beams, and vertically between said bridge plate and said yoke.

7. The fixture according to claim 1, wherein said dampener housing further includes:

a clamp for connecting said yoke to said fore plate.

8. The fixture according to claim 1, further comprising:

a wheel mount for each of said first and second posts, said wheel mount including a wheel for rolling the fixture on the ground.

9. The fixture according to claim 8, wherein said first and second posts each include a helical spring to support corresponding said wheel mount.

10. The fixture according to claim 1, the weapons mount includes a rotatable turret.

11. The fixture according to claim 1, wherein said outrigger beams each comprises a proximal sleeve and a distal arm that retractably telescopes into said proximal sleeve.

12. The fixture according to claim 11, wherein said outrigger beams each further includes a linear actuator for extending said distal arm from said proximal sleeve.

13. The fixture according to claim 1, wherein said slide assembly further includes:

a slider box extending laterally to support said deck; and first and second brackets that extend longitudinally from said slider box for enabling the vehicle to drive away from the fixture.

* * * * *